US006085525A

United States Patent [19]

Håkansson

[11] Patent Number: 6,085,525

[45] Date of Patent: Jul. 11, 2000

[54] VALVE FOR VARYING THE EXHAUST COUNTERPRESSURE IN AN INTERNAL COMBUSTION ENGINE

[75] Inventor: Nils Olof Håkansson, Stenkullen, Sweden

[73] Assignee: AB Volvo, Gothenburg, Sweden

[21] Appl. No.: 09/091,467

[22] PCT Filed: Dec. 19, 1996

[86] PCT No.: PCT/SE96/01711

§ 371 Date: Jun. 18, 1998

§ 102(e) Date: Jun. 18, 1998

[87] PCT Pub. No.: WO97/22788

PCT Pub. Date: Jun. 26, 1997

[30] Foreign Application Priority Data

Dec. 19, 1995 [SE] Sweden ..... 9504543

[51] Int. Cl.[7] ..... F02B 37/12

[52] U.S. Cl. ..... 60/602; 251/63.5

[58] Field of Search ..... 60/602; 251/62, 251/63.5

[56] References Cited

FOREIGN PATENT DOCUMENTS 58-72640 4/1983 Japan .
WO 94/29583 12/1994 WIPO .

*Primary Examiner*—Noah P. Kamen
*Attorney, Agent, or Firm*—Young & Thompson

[57] ABSTRACT

A throttle valve having a housing with an inlet and an outlet intended to be connected to an exhaust conduit of an internal combustion engine. The housing has a cylinder which is perpendicularly directed towards an exhaust passage between the inlet and outlet. The cylinder communicates with the exhaust passage and has a piston with valve discs at each end. In the open position of the valve, a distal valve disc abuts against a distal seat in the cylinder, and in a throttled position, a proximal valve disc abuts against a proximal seat.

11 Claims, 2 Drawing Sheets

VALVE FOR VARYING THE EXHAUST COUNTERPRESSURE IN AN INTERNAL COMBUSTION ENGINE

BACKGROUND OF THE INVENTION

The present invention relates to a valve device, comprising a housing with an inlet and an outlet to be connected to an exhaust conduit in an internal combustion engine, an exhaust passage disposed between the inlet and outlet, a valve body which can be set in various positions to vary the throughflow area of the exhaust passage, and operating means for setting the valve body.

It is known that it is possible by merely increasing the exhaust counterpressure in the exhaust conduit of an internal combustion engine, with the aid of a valve device of the above mentioned type, to achieve an increase in the engine braking effect of the vehicle. A further increase in the engine braking effect can be achieved if communication is established in a known manner between the exhaust system and the engine cylinders during the latter portion of the intake stroke, so that gas from the exhaust system can flow into the cylinders. This results in a pressure increase in the cylinder, and an inner charging pressure which increases the compression work after cutting off the communication between the cylinders and the exhaust system.

A known type of valve device for varying the exhaust counterpressure is an exhaust pressure regulator comprising a damper in the exhaust conduit. Great demands are placed on the design of damper valves which must be able to function with high reliability and lone life in the exhaust conduit environment. They must be able to withstand high mechanical and thermal stresses. In the open position, they must not provide any flow impediment or create turbulence in the exhaust conduit, and they must not stick so that they do not reach their defined positions, something which often happens after a relatively short operating period due to deposits of soot.

SUMMARY OF THE INVENTION

The purpose of the present invention is in general to achieve a valve device of the type described above which can withstand higher thermal and mechanical stresses than a damper valve and which has a simple design and high reliability. The particular purpose is to achieve a valve device which makes it possible in a turbocharged engine to utilize the turbo unit in a better manner than previously in order to vary the braking power of the engine.

This is achieved according to the present invention by virtue of the fact that the housing has a cylinder communicating with the exhaust passage, the cylinder housing having radial play and a valve body in the form of a piston displaceable into the passage under the effect of a pressure medium. The piston has at its distal and proximal end surfaces, valve discs where the proximal disc in an extended position of the piston abut against a proximal seat formed in the cylinder, and the distal disc in a retracted position of the piston abut against a distal seat formed in the cylinder.

In such a valve device, the piston is the only moving part. The piston does not require any return springs or particular operating means, since it functions in itself as both the valve body in a valve housing, and as the operating piston in an operating cylinder.

It has been shown that a valve device according to the present invention, in contrast to a damper valve, can function as a throttle valve in the extremely aggressive environment prevailing in engine exhaust pipes. In a turbocharged engine it can be arranged as a throttle valve upstream of the turbine portion of the turbocompressor unit, which provides a number of advantages.

By placing a valve device closer to the exhaust outlet of the cylinders, the volume of the exhaust conduits is reduced between the exhaust valves and the valve device in the exhaust conduit, which means that the pistons need not force out as much gas as previously to create a certain level of counterpressure. High counterpressure can therefore be obtained more rapidly.

In a turbocharged engine with the exhaust pressure regulator downstream of the turbine, the pressure drop required over the turbine to enable the turbine to drive the compressor, is not obtained in a braking mode. By arranging instead a throttle valve device prior to the turbine portion, and adapting the throttle area to the turbine area, the turbocompressor unit can provide supercharging even in a braking mode. It is true that the pistons have energy imparted from the gas during the intake stroke, but the work which the pistons must perform during the compression stroke against the gas is so much greater that the net result will be higher braking power. Another advantage of circulating large volumes of gas through the engine in braking mode is that a greater amount of heat is removed with the gas than in installations with exhaust pressure regulators, in which the heat is primarily dissipated by the coolant.

The turbine portion of the turbocompressor unit, which is dimensioned to work within the normal engine speed range when in a driving mode, will be too large to be able to supercharge in the braking mode. The valve device according to the invention can therefore be used with advantage in turboengines with turbines which have variable geometry, or in so-called turbocompound engines which have a turbocompressor unit with a first turbine step driving the compressor unit, and a second turbine step coupled via a transmission to the engine crankshaft. In such turbo units, the first turbine step is a small high-pressure turbine, while the second turbine step is a larger, low pressure turbine. It has been found that the corrected mass flow to the compressor turbine the braking mode is approximately equal to that the turbo compound driving mode. In a conventional turbo engine, however, the compressor turbine is significantly larger, which means that the corrected mass flows during braking mode and driving mode will be approximately equal at engine speeds above normal driving mode rpms.

BRIEF DESCRIPTION OF THE DRAWINGS

The invention will be described in more detail below with reference to examples shown in the accompanying drawings, where.

DESCRIPTION OF THE PREFERRED EMBODIMENT

Figure 1:
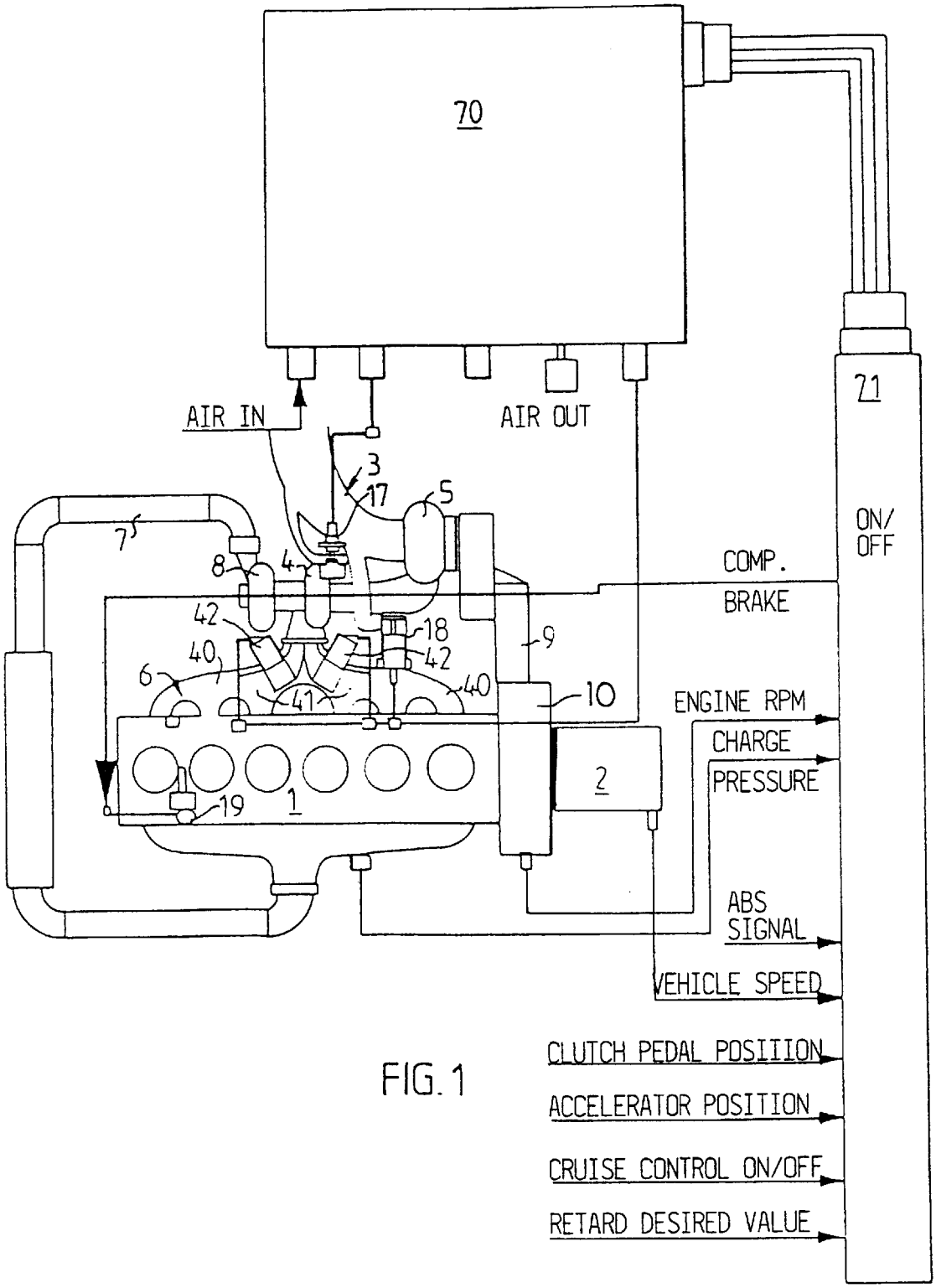
FIG. 1 shows schematically a turbo compound engine with a valve device according to the present invention.

In FIG. 1, the numeral 1 designates a six-cylinder engine with gearbox 2. A turbo compressor unit, generally designated 3, has a first turbine step 4 and a second turbine step 5 coupled to the engine exhaust manifold 6. The first turbine step 4 is a small high-pressure step, which drives a compressor 8 coupled to the engine intake conduit 7, while the second turbine step 5 is a larger low-pressure step, which is coupled, via a transmission 9 to the engine crankshaft 10. Via a first continuously variable waste-gate valve 17, a greater or smaller portion of the exhaust can be shunted past the high-pressure turbine 4 for the purpose of varying the degree of charge. Via a second waste-gate valve 18, the exhaust can be shunted past the low-pressure turbine 5. The engine 1 has a schematically indicated compression braking device 19.

Figure 2:
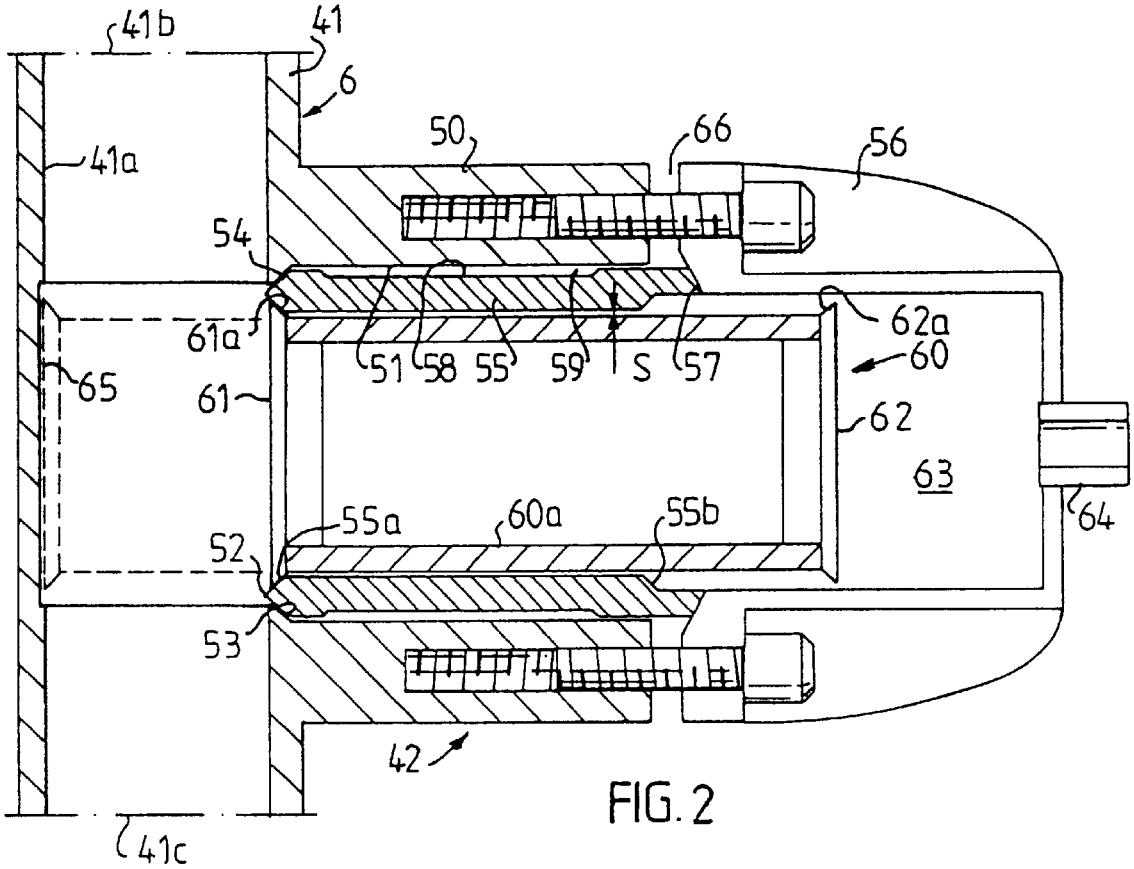
FIG. 2 shows a longitudinal section through one embodiment of a valve device according to the present invention.

In FIG. 2, the exhaust manifold 6 is divided into two submanifolds 40, having exhaust conduits 41 of which converge prior to the inlet of the turbo compressor unit 3. In each exhaust conduit 41, there is a throttle valve 42 according to the invention, which has a completely open position, and a throttle position in which the exhaust passage 41*a* of the exhaust conduit 41, between the inlet 41*b* and the outlet 41*c*, is reduced to create an exhaust counterpressure in the exhaust manifold 6 during engine braking.

A valve, which is to function in the environment prevailing in an exhaust manifold, must be able to withstand high mechanical and thermal stresses. In its open position it must not constitute a flow hindrance or create turbulence in the exhaust conduit. Valve 42 fulfils these requirements and is shown in more detail in FIG. 2, where 50 designates a cylindrical valve housing which is preferably cast in one piece with the exhaust manifold 6. The cylinder space 51 in the housing 50 opens into the interior of the exhaust conduit 41. The opening 52 itself is surrounded by a conical seat 53, against which a corresponding seat 54 at one end of a sleeve 55 of stainless steel abuts. The sleeve 55 is held in place by a cover 56 screwed securely to the housing portion 50. The cover 56 presses with a conical surface 57 against a corresponding conical surface at the opposite end of the sleeve 55. The sleeve 55 has a portion 58 of reduced diameter in order to form a cylindrical airgap 59, which communicates with the surrounding air via an annular gap 66 between the housing portion 50 and the cover 56.

Inside the sleeve 55 there is disposed a valve body in the form of a hollow piston 60. As can be seen in FIG. 2. there is a small play "s" between outer lateral surface of the piston 60 and the inner lateral surface of the sleeve 55. The cylindrical portion of the piston 60 consists of a tube 60*a* of hard chromium plated stainless steel. At the ends, the piston end pieces 61,62 are fixed to the tube 60*a*. These form valve discs with conical edge portions 60*a*,62*a* and are preferably sintered. The sleeve 55 is provided at its distal end with a seat 55*a*, against which the edge portion 61*a* of the disc 61 abuts sealingly in the open position of the valve (as shown in FIG. 2). When air pressure exceeding ca 8 bars is supplied to the cylinder chamber 63 via an inlet 64, the piston 60 is displaced to the left in FIG. 2 at the same time as the leaking air in the gap "S" blows out any soot. The piston 60 is displaced perpendicularly to the exhaust conduit 41 and stops with its disc 61 a short distance from a surface 65 on the opposite wall portion of the conduit 41, when the conical edge portion 62*a* of the disc 62 strikes a proximal conical seat 55*b* of the sleeve 55, so that exhaust gases cannot leak into the cylinder chamber. As long as there is pressure in the cylinder chamber, the piston 60 will be held in its throttle position. The diameter of the piston 60 and the cross-section of the conduit 41 are adapted to each other so that a throttled passage for exhaust is obtained between the interior wall of the conduit and the piston. When the piston 60 is to be returned to the starting position in FIG. 2, the cylinder chamber 63 is drained, and the exhaust pressure which is propagated through the gap "S" and acts against the disc edge 62 a will displace the piston into the sleeve 55. No return springs are required and the only moving part of the valve is the piston 60, which results in high reliability.

The compression braking device 19 is electrically operated, while the waste-gate valves 17,18 and the throttle valves 42 are pneumatically operated. They are controlled by a control valve unit 70 connected to a pressure source (not shown) and a control unit 71, which is preferably a microprocessor, which provides output signals for turning the compression braking device on and off and for setting the valves 17,18 and 42 depending on a number of different engine and vehicle data fed into the control unit from sensors known per se and not shown in more detail here. As is indicated in FIG. 1, signals are fed into the control unit 71 representing charge pressure and engine speed, i.e. engine data, and signals representing ABS on/off, vehicle speed, clutch pedal position, accelerator position, cruise control on/off and retardation level, i.e. vehicle data.

The device can function as follows:

The driver sets, by manual means (not shown), the retardation to a certain level and activates the cruise control. so that a signal representing selected retardation is fed into the control unit 71, which compares the command value fed in for retardation with the computed actual value of retardation computed via the actual speed value. When the driver lets up on the accelerator, assuming the clutch pedal is not depressed, the control unit 71 will set, via the control valve unit 70, the throttle valves 42 in the throttle position, will open the waste-gate valve 18 to shunt past the second turbine step 5 and will, depending on the difference between the actual value and the command value, regulate via the waste-gate valve 17 the suitable degree of charge in the first turbine step 4 and activate the compression braking device 19. If the selected retardation level should be too high in view of the road conditions, so that the drive wheels slip, the ABS on/off will provide a signal to reduce the engine braking power by turning off the compression brake 19 and then turning it on again at a lower retardation level or alternatively providing the driver with the possibility of selecting a lower retardation level. Turning off the compression brake 19 also occurs if the driver should depress the clutch pedal, which is important in order to prevent engine shut off with accompanying loss of servo assisted steering and brakes.

What is claimed is:

1. A valve device, comprising:

a housing with an inlet and an outlet to be connected to an exhaust conduit in an internal combustion engine;

an exhaust passage disposed between said inlet and outlet;

a valve body, which can be set in various positions between an open and a closed condition to vary a flowthrough area of said exhaust passage; and operating means for setting said valve body, wherein said housing has a cylinder communicating with said exhaust passage, said cylinder having a piston therein comprising a distal end which is displaceable into said exhaust passage, said piston having a distal valve disc and a proximal valve disc located at said distal end and at an opposing proximal end of said piston, respectively, said proximal valve disc, in an extended position of said piston abutting against a proximal seat in said cylinder, and said distal valve disc, in a retracted position of said piston, abutting against a distal seat in said cylinder.

2. A valve device according to claim 1, wherein a center axis of said cylinder intersects a center axis of said exhaust passage at a right angle.

3. A valve device according to claim 1, wherein said cylinder comprises a sleeve and a gap between said sleeve and a cylindrical surface in said housing, said housing being cast in one piece integral with an exhaust manifold.

4. A valve device according to claim 3, wherein said sleeve consists of stainless steel.

5. A valve device according to claim 1, wherein said piston comprises a metal tube, and said distal and proximal valve discs each comprise a conical edge surface.

6. A valve device according to claim 5, wherein said piston consists of stainless, hard chromium-plated steel and said proximal and distal valve discs each comprise sintered metal.

7. A valve device according to claim 1, in an internal combustion engine in a motor vehicle equipped with an exhaust-driven turbo compressor unit with a turbine portion and a compressor portion, the valve device further comprising said inlet in communication with an engine exhaust outlet and said outlet in communication with an inlet of the turbine portion wherein said piston in the retracted position provides free exhaust passage between said inlet and outlet, and in an extended position, said piston reduces said flowthrough area of said exhaust passage.

8. The valve device of claim 1, further comprising a pressure controller connected to said housing at said proximal end of said piston for moving said piston.

9. The valve device of claim 8, wherein said pressure controller is a pneumatic pressure controller.

10. The valve device of claim 8, wherein said pressure controller comprises a microprocessor.

11. The valve of claim 3, wherein said housing further comprises an external annular opening communicating with said gap.

* * * * *